US011067106B2

(12) United States Patent
Wang et al.

(10) Patent No.: US 11,067,106 B2
(45) Date of Patent: Jul. 20, 2021

(54) SYSTEM FOR IMPLEMENTING REDUNDANCY IN HYDRAULIC CIRCUITS AND ACTUATING MULTI-CYCLE HYDRAULIC TOOLS

(71) Applicant: Schlumberger Technology Corporation, Sugar Land, TX (US)

(72) Inventors: Chao Wang, Missouri City, TX (US); Julien Bost, Sugar Land, TX (US); Abbigail Ullrich, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 158 days.

(21) Appl. No.: 15/989,238

(22) Filed: May 25, 2018

(65) Prior Publication Data

US 2019/0360508 A1 Nov. 28, 2019

(51) Int. Cl.

| | |
|---|---|
| ***F15B 20/00*** | (2006.01) |
| ***E21B 34/10*** | (2006.01) |
| ***E21B 33/12*** | (2006.01) |

(52) U.S. Cl.

CPC ..... *F15B 20/008* (2013.01); *E21B 33/12* (2013.01); *E21B 34/10* (2013.01)

(58) Field of Classification Search

CPC ..... E21B 33/12; E21B 34/10

See application file for complete search history.

(56) References Cited

U.S. PATENT DOCUMENTS

| | | | | |
|---|---|---|---|---|
| 4,796,699 | A * | 1/1989 | Upchurch | E21B 47/18 166/250.17 |
| 4,856,595 | A * | 8/1989 | Upchurch | E21B 34/06 166/374 |
| 4,893,505 | A * | 1/1990 | Marsden | E21B 47/06 73/152.24 |
| 4,896,722 | A * | 1/1990 | Upchurch | E21B 34/16 166/250.15 |
| 5,101,907 | A * | 4/1992 | Schultz | E21B 23/04 166/386 |
| 6,450,263 | B1 | 9/2002 | Schwendemann | |
| 6,659,184 | B1 * | 12/2003 | Tips | F15B 13/01 166/375 |

(Continued)

FOREIGN PATENT DOCUMENTS

| | | |
|---|---|---|
| JP | 52082926 U | 6/1977 |
| JP | 2010096192 A | 4/2010 |

(Continued)

OTHER PUBLICATIONS

International Search Report and Written Opinion issued in the related PCT Application PCT.US2019/033825 dated Sep. 5, 2019 (11 pages).

(Continued)

*Primary Examiner* — Matthew Troutman
*Assistant Examiner* — Neel Girish Patel
(74) *Attorney, Agent, or Firm* — Cameron R. Sneddon

(57) ABSTRACT

A system and method for providing redundancy in hydraulic circuits in multi-cycle hydraulic tools is described. The problems of dysfunctional hydraulic tool due to the failure of electromechanical actuators are addressed by providing redundant actuators and associated circuitry design.

20 Claims, 7 Drawing Sheets

(56) References Cited

U.S. PATENT DOCUMENTS

| | | | | |
|---|---|---|---|---|
| 9,316,076 | B2 | 4/2016 | Longfield et al. | |
| 2012/0168146 | A1* | 7/2012 | Filas | E21B 23/04 166/66.5 |
| 2012/0285702 | A1 | 11/2012 | Rytlewski | |
| 2013/0068472 | A1* | 3/2013 | Lauderdale | E21B 34/14 166/373 |
| 2019/0048901 | A1* | 2/2019 | Bedrossian | E21B 34/16 |

FOREIGN PATENT DOCUMENTS

| | | |
|---|---|---|
| KR | 1020000012869 | 3/2000 |
| KR | 1020160015154 | 2/2016 |

OTHER PUBLICATIONS

International Preliminary Report on Patentability issued in the PCT Application PCT/US2019/033825 dated Dec. 10, 200 (8 pages).

* cited by examiner

SYSTEM FOR IMPLEMENTING REDUNDANCY IN HYDRAULIC CIRCUITS AND ACTUATING MULTI-CYCLE HYDRAULIC TOOLS

FIELD OF THE DISCLOSURE

The disclosure generally relates to a hydraulic actuation system, and more particularly to a system for implementing redundancy in hydraulic circuits actuating multi-cycle hydraulic tools.

BACKGROUND OF THE DISCLOSURE

The hydraulic circuit of a multi-cycle electro-hydraulic tool, such as those used in a downhole tester/circulating valve, is composed of several parts: a pressurized hydraulic oil reservoir that provides energy to the circuit; a power piston that moves up and down to open or close the tool, and in the process consumes a significant amount of oil from the reservoir; a spool valve that moves up and down to control the position of the power piston, and in the process consumes a very small amount of oil from the reservoir; an electro-mechanical actuator/valve that opens and closes to control the position of the spool valve; and a dump chamber that is initially empty to which all the consumed oil is released.

For example, FIG. 1A shows a prior art hydraulic tool, where a circulating valve 20 and a test valve 14 are installed above a packer 12. The circulating valve 20 controls the open and close of the tool. The detail of the circulating valve 20 is shown in FIG. 1B, having a piston 26 driven by hydraulic fluid supplied from an actuator line 38 that is in fluid communication with a hydraulic fluid reservoir 42 and a dump chamber 57, along with several solenoid valves 44, 53, and a pilot valve 50 that control the pressure of the actuator line 38.

In this exemplary prior art, just like most tools, the electro-mechanical actuator/valve is the less-reliable component of the system due to the electro-mechanical design and the tough environment the tools are put into work. A malfunction or breaking down of a single electro-mechanical actuator/valve may cause the entire tool to shut down for maintenance or repair, which in turn delays the operation.

Therefore, there is the need for a system that has redundant circuitry for actuating multi-cycle hydraulic tools.

SUMMARY OF THE DISCLOSURE

The present disclosure includes any of the following embodiments in any combination(s) of one or more thereof:

According to an aspect of the present disclosure, one or more embodiments relate to a system of operating a downhole well hydraulic tool, comprising: a hydraulic tool having at least one hydraulic port for receiving hydraulic fluid to control the movement of a piston inside the hydraulic tool; a plurality of hydraulic reservoirs connected in parallel and each in fluid communication with the hydraulic port of the hydraulic tool, each said hydraulic reservoirs being operatively connected to a corresponding hydraulic actuator that controls the release of hydraulic fluid from the hydraulic reservoirs; and a plurality of dump containers each in fluid communication with the hydraulic port of the hydraulic tool, each said dump containers being operatively connected to a corresponding dump actuator that controls the dump containers for receiving hydraulic fluid.

According to another aspect of the present disclosure, one or more embodiments relate to a system of operating a downhole well hydraulic tool, comprising: a hydraulic tool having at least one hydraulic port for receiving hydraulic fluid to control the movement of a piston inside the hydraulic tool; a plurality of hydraulic actuators connected in parallel and each in fluid communication with the hydraulic port of the hydraulic tool; and a plurality of dump actuators connected in parallel and each in fluid communication with the hydraulic port of the hydraulic tool; a plurality of hydraulic containers in fluid communication with the hydraulic port of the hydraulic tool, the plurality of hydraulic containers each operatively coupled to one of the plurality of hydraulic actuators and one of the plurality of dump actuators; and a hydraulic pressure compensating unit in fluid communication with the hydraulic port of the hydraulic tool.

According to another aspect of the present disclosure, one or more embodiments relate to a method of operating a multi-cycle downhole tool, the multi-cycle downhole tool having at least one hydraulic port for receiving hydraulic fluid to control the movement of a piston inside the hydraulic tool, a plurality of hydraulic reservoirs each in fluid communication with the hydraulic port of the hydraulic tool, each of said hydraulic reservoirs being operatively connected to a corresponding hydraulic actuator that controls the release of hydraulic fluid from the hydraulic reservoirs, and a plurality of dump containers each in fluid communication with the hydraulic port of the hydraulic tool and being operatively connected to a corresponding dump actuator that controls the dump containers for receiving hydraulic fluid, the method comprising: (a) firing one of said dump actuator to drain hydraulic fluid into the corresponding dump container; (b) firing one of said hydraulic actuator to release hydraulic fluid from the corresponding hydraulic reservoir to the hydraulic port of the hydraulic tool; and repeating steps (a)-(b).

These together with other aspects, features, and advantages of the present disclosure, along with the various features of novelty, which characterize the invention, are pointed out with particularity in the claims annexed to and forming a part of this disclosure. The above aspects and advantages are neither exhaustive nor individually or jointly critical to the spirit or practice of the disclosure. Other aspects, features, and advantages of the present disclosure will become readily apparent to those skilled in the art from the following detailed description in combination with the accompanying drawings. Accordingly, the drawings and description are to be regarded as illustrative in nature, and not restrictive.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Figure 1A:
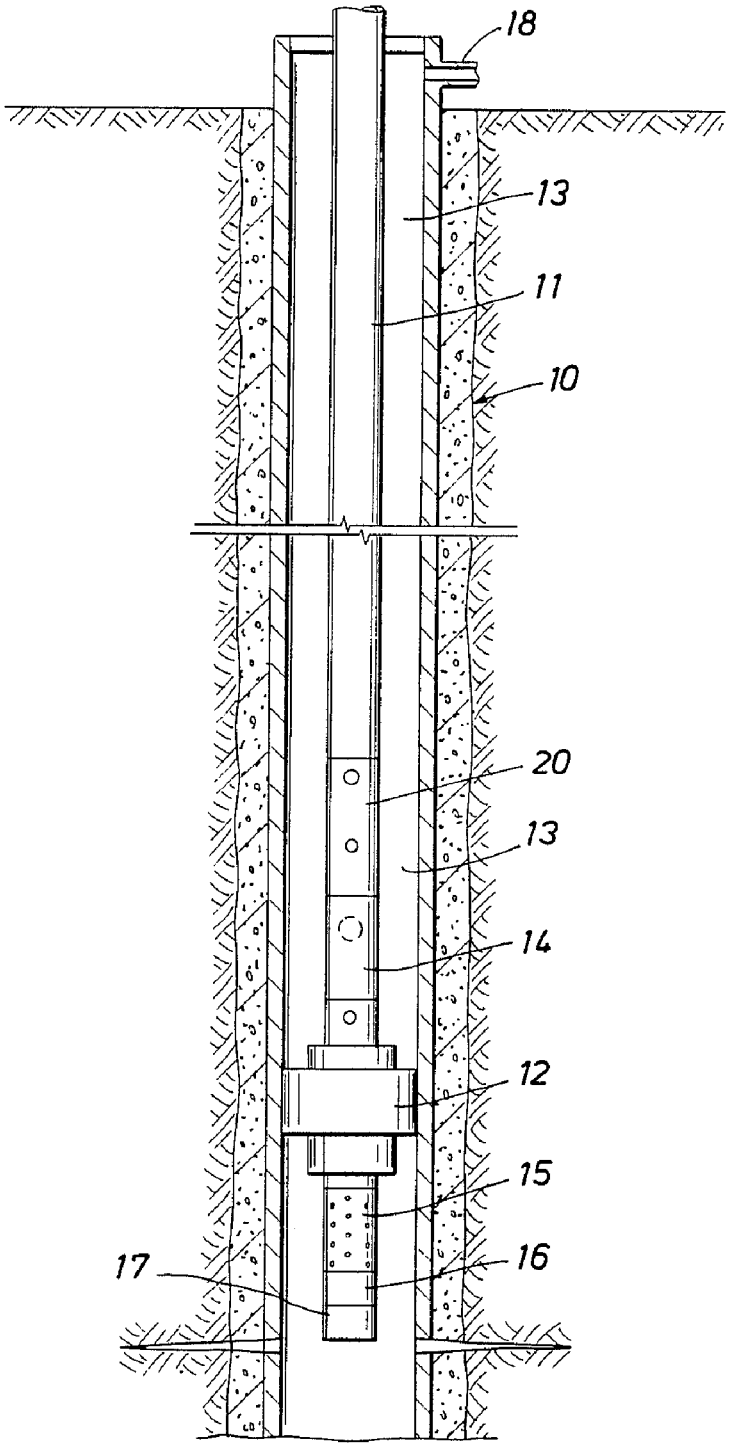
FIGURE 1A (PRIOR ART)
FIG. 1A-B. A conventional multi-cycle hydraulic circuitry that has no redundancy.
Figure 1B:
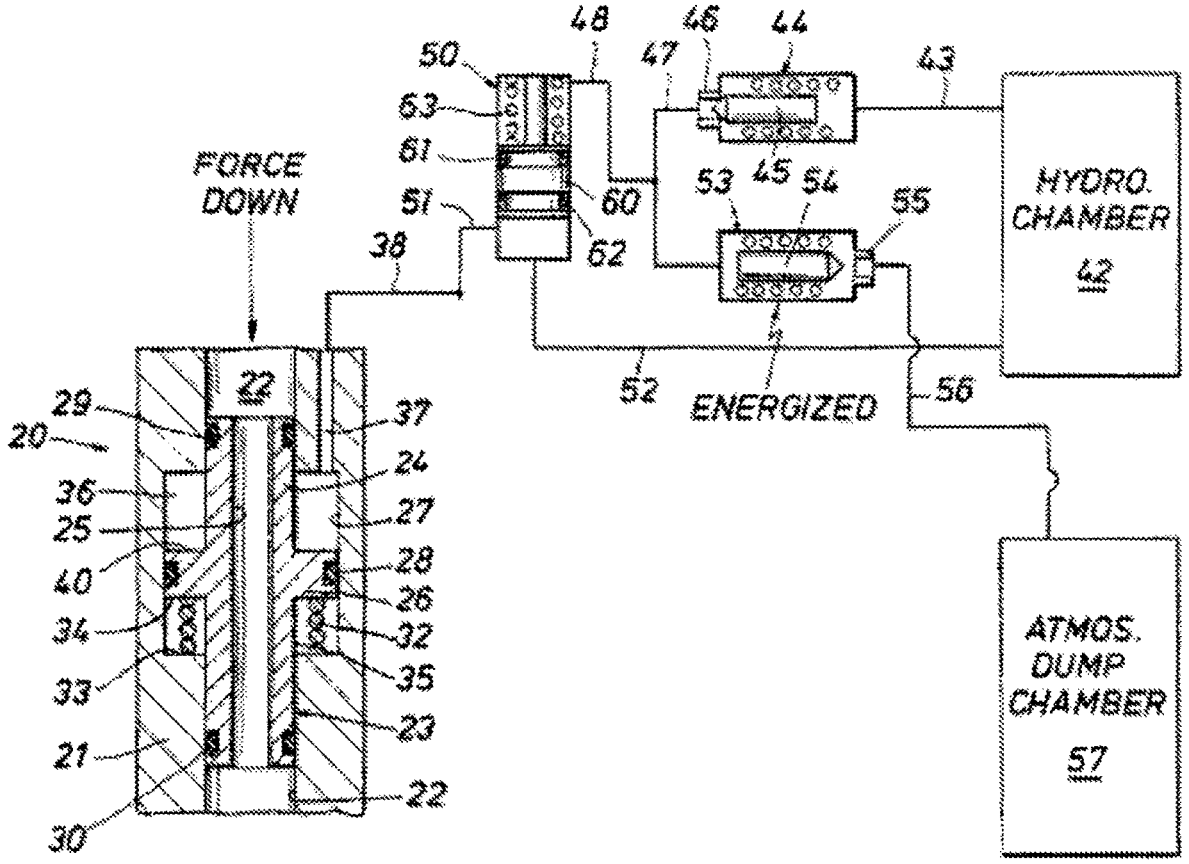
FIGURE 1B (PRIOR ART)

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

As used herein, "hydraulic tool" refers to downhole tools that rely on a hydraulic system to actuate the open or close (on or off) status of the downhole tool.

As used herein, "actuator" refers to an actuator or valve that is controlled by an electrical, pneumatic or hydraulic signal and in turn converting the signal into mechanical, pneumatic or hydraulic motions that actuate its associated component.

As used herein, "reservoir" refers to a container for storing hydraulic fluid to be used in the hydraulically actuated system.

As used herein, "dump" refers to the action of removing hydraulic fluid from the pressurized hydraulic line, thereby reducing the pressure in the hydraulic system.

As used herein, "oil compensation" refers to an apparatus comprising hydraulic fluid and a pump for the purpose of maintaining the pressure of the hydraulic system above or below a predetermined value.

The disclosure provides a novel system to implement redundancy in hydraulic circuits actuating multi-cycle hydraulic tools. In particularly, a plurality of hydraulic circuits with corresponding electro-mechanical actuators that can cycle a multi-cycle tool is provided. This redundancy is achieved by using a series of electro-hydraulic actuators that are each coupled with a dedicated reservoir and dump cartridge. With the redundancy in the system, it is possible to increase the reliability of multi-cycle downhole hydraulic tools in cases where one or more of the electro-mechanical actuator/valves are not operational.

In a typical multi-cycle tool there are two electromechanical actuators/valves that control all the movements in one direction, e.g. one actuator controls the piston to move in a first direction all the time, and the other actuator controls the piston to move in a direction opposite the first direction all the time. If either of the actuators breaks down, the tool does not work. Unfortunately, the electromechanical actuators or valves are often the less reliable part of a downhole tool, particularly due to the temperature and pressure condition at or near a subterranean reservoir. Therefore, the current disclosure provides a system with multiple redundant actuators, where each actuator will control only a one-time movement of the power piston.

Specifically, each actuator will control the flow of either a pressurized oil reservoir or dump cartridge to the spool valve pilot line. Each pair of reservoir and dump actuator will provide one cycle to the tool, e.g. one movement up and one movement down. For example, if the actuator to a pressurized reservoir is actuated, the oil reservoir is open (or ruptured in a rupture disc), and the pressurized hydraulic oil will flow into the pilot line of a spool valve that controls the hydraulic pressure to the hydraulic tool. With the pilot line being pressurized, the piston inside the power tool is pushed up. When the hydraulic tool needs to be opened, an actuator for the dump cartridge is actuated and the spool valve is switched to allow the pressurized hydraulic oil being released into the dump cartridge. The power piston in the hydraulic tool then moves down.

With the setting according to this disclosure, multiple cycles are achieved through use of multiple pairs of reservoir and dump actuators. For example, a six-pair system can provide six up movements and six down movements of the piston. More cycles are possible with additional pairs. Further, the redundancy of the reservoir/dump pairs in the circuitry ensures that even if one or more of the pairs break down, the system can still be functional by using the alternative pairs.

Figure 2:
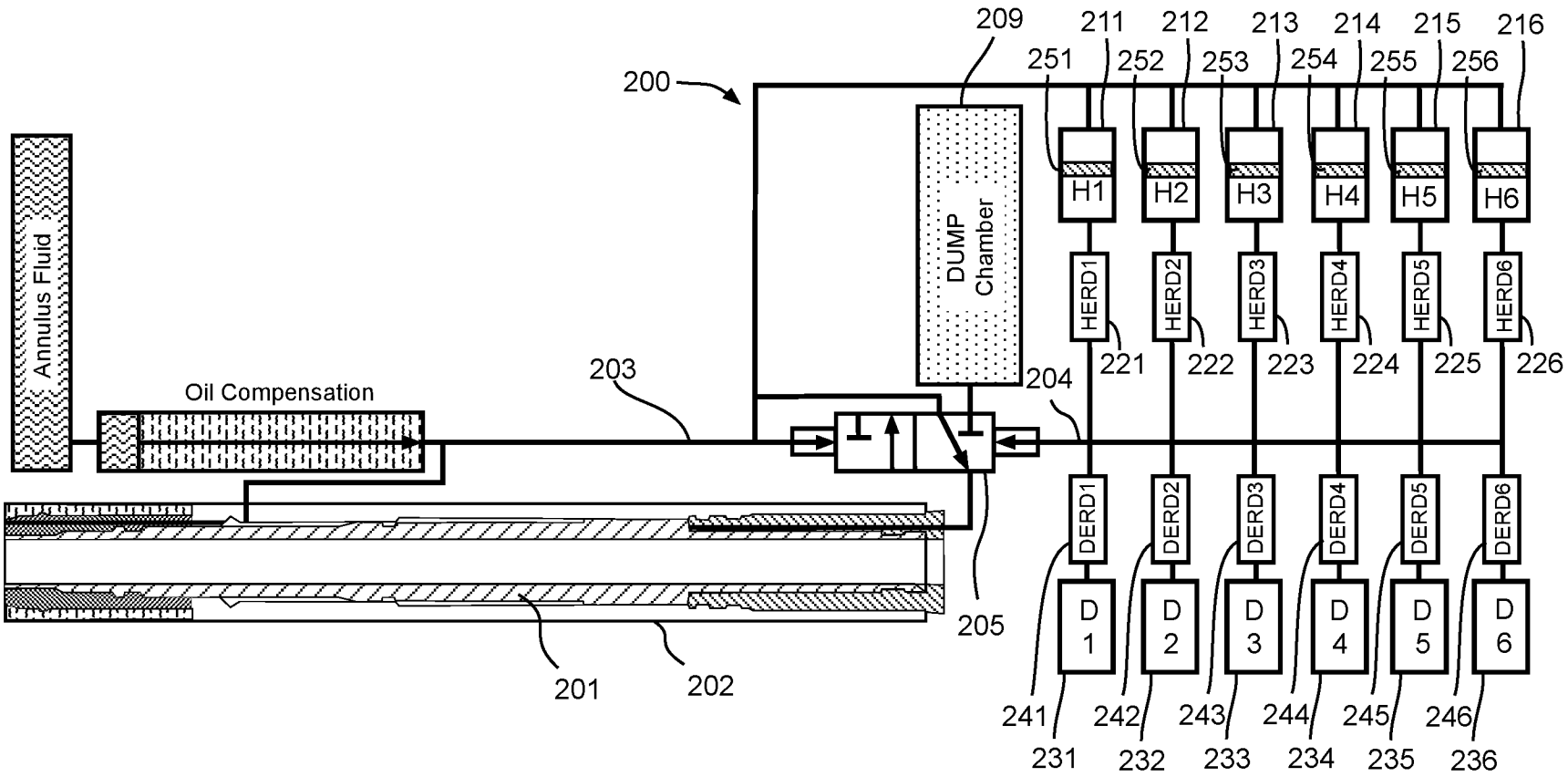
FIG. 2. A schematic illustration of an embodiment of this disclosure.

With reference to FIG. 2, an embodiment of this disclosure is shown. As shown in FIG. 2, a multi-cycle tool 201 is connected to a pipe string (not shown) within a wellbore 202. In one embodiment, the multi-cycle tool 201 works with or is associated with a typical packer that acts to isolate the well interval being tested from the hydrostatic head of fluids in the annulus thereabove, and a main test valve assembly that serves to permit or to prevent the flow of formation fluids from the isolated interval into the pipe string. The main test valve assembly (not shown) is closed while the tools are being lowered, so that the interior of the tubing provides a low pressure region into which formation fluids can flow. After the packer is set, the test valve assembly is opened (hydraulically driven) for a relatively short flow period of time during which pressure in the well bore is reduced. Then the test valve assembly is closed for a longer flow period of time during which pressure build-up in the shut-in well bore is recorded. Other equipment components such as a jar and a safety joint can be coupled between the test valve assembly and the packer, but are not illustrated in the drawing.

In the present embodiment, the multi-cycle tool 201 is connected to a (pilot) spool valve 202 through a hydraulic line 203. Six hydraulic fluid reservoirs 211,212,213,214, 215,216 are provided in parallel, and each is in fluid communication with the (pilot) spool valve 205 through the pilot line 204. Each of the hydraulic fluid reservoirs contains a piston 251, 252, 253, 254, 255, 256. Each of the hydraulic fluid reservoirs 211,212,213,214,215,216 is controlled by a corresponding actuator 221,222,223,224,225,226 that can be remotely or electronically actuated. Upon actuation, the actuator will open the hydraulic fluid reservoirs through, for example, a rupture disc. However, different mechanism for opening the hydraulic fluid reservoirs is also contemplated, such as a directional control valve or one-way valve that only allows the hydraulic fluid to flow out of the reservoirs. The hydraulic fluid in the opened reservoir then pressurizes the pilot line of the spool valve 205.

Six dump cartridges 231,232,233,234,235,236 are also provided in parallel, and each is in fluid communication with the (pilot) spool valve 205. Each of the dump cartridges 231,232,233,234,235,236 is controlled by a corresponding dump actuator 241,242,243,244,245,246 that can be remotely or electronically actuated. Upon actuation, the dump actuator will open the dump cartridge, allowing the previously released hydraulic fluid to flow back into the dump cartridges.

Figure 5:
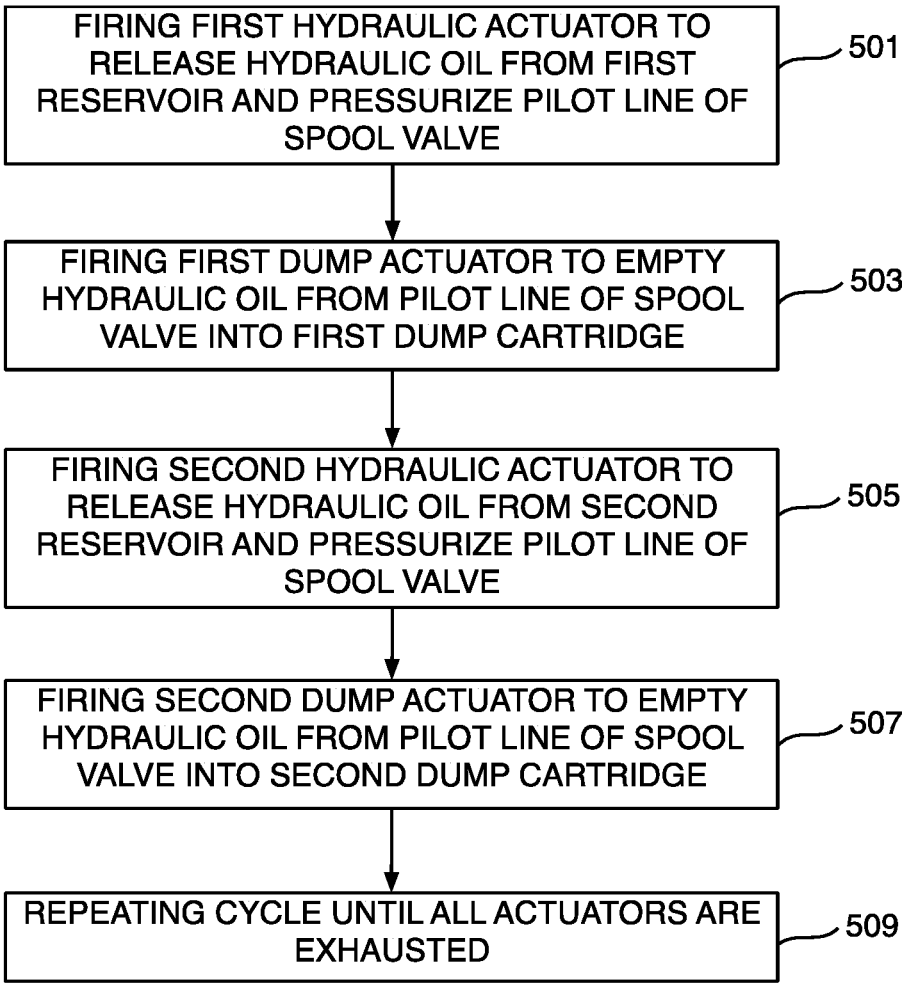
FIG. 5. A flow chart according to one embodiment of this disclosure.

With reference to both FIG. 2 and FIG. 5, for example, in the first cycle, starting from Step 501, the operator fires the first actuator 221 to open the first hydraulic fluid reservoir 211 that contains hydraulic oil. The hydraulic oil then fills the pilot line 204 of the spool valve 205. The spool valve 205 therefore goes up, which in turn drives the power piston up inside the multi-cycle tool 201 and closes the multi-cycle tool 201.

After a period of fluid flow, in Step 503, the operator fires the first dump actuator 241 to open the first dump cartridge 231. This also triggers the spool valve 205 to go down by allowing the hydraulic oil inside the pilot line 204 to dump into the first dump cartridge 231. The power piston inside the multi-cycle tool 201 goes down and opens the multi-cycle tool 201.

Similarly, in the second cycle, according to Step 505, the operator fires the second actuator 222 to open the second hydraulic fluid reservoir 212 that contains hydraulic oil. The hydraulic oil then fills the pilot line 204 of the spool valve 205. The spool valve 205 therefore goes up, which in turn drives the power piston up inside the multi-cycle tool 201.

After a second flow period, according to Step 507, the operator again fires the second dump actuator 242 to open the second dump cartridge 232. This again triggers the spool valve 205 to go down by allowing the hydraulic oil inside the pilot line 204 to dump into the second dump cartridge 232. The power piston inside the multi-cycle tool 201 goes down and opens the multi-cycle tool 201.

The cycles are repeated, according to step 509, until all actuators are exhausted.

With six pairs of hydraulic reservoirs and dump cartridges and their corresponding actuators, the redundant circuitry 200 allows six one-time up and down cycles to open and close the multi-cycle tool 201. Even in the case any one or more of the six pairs is not operational due to mechanical or electrical failure, the other pairs can still function as an alternative to ensure the functionality of the multi-cycle tool 201.

Figure 3:
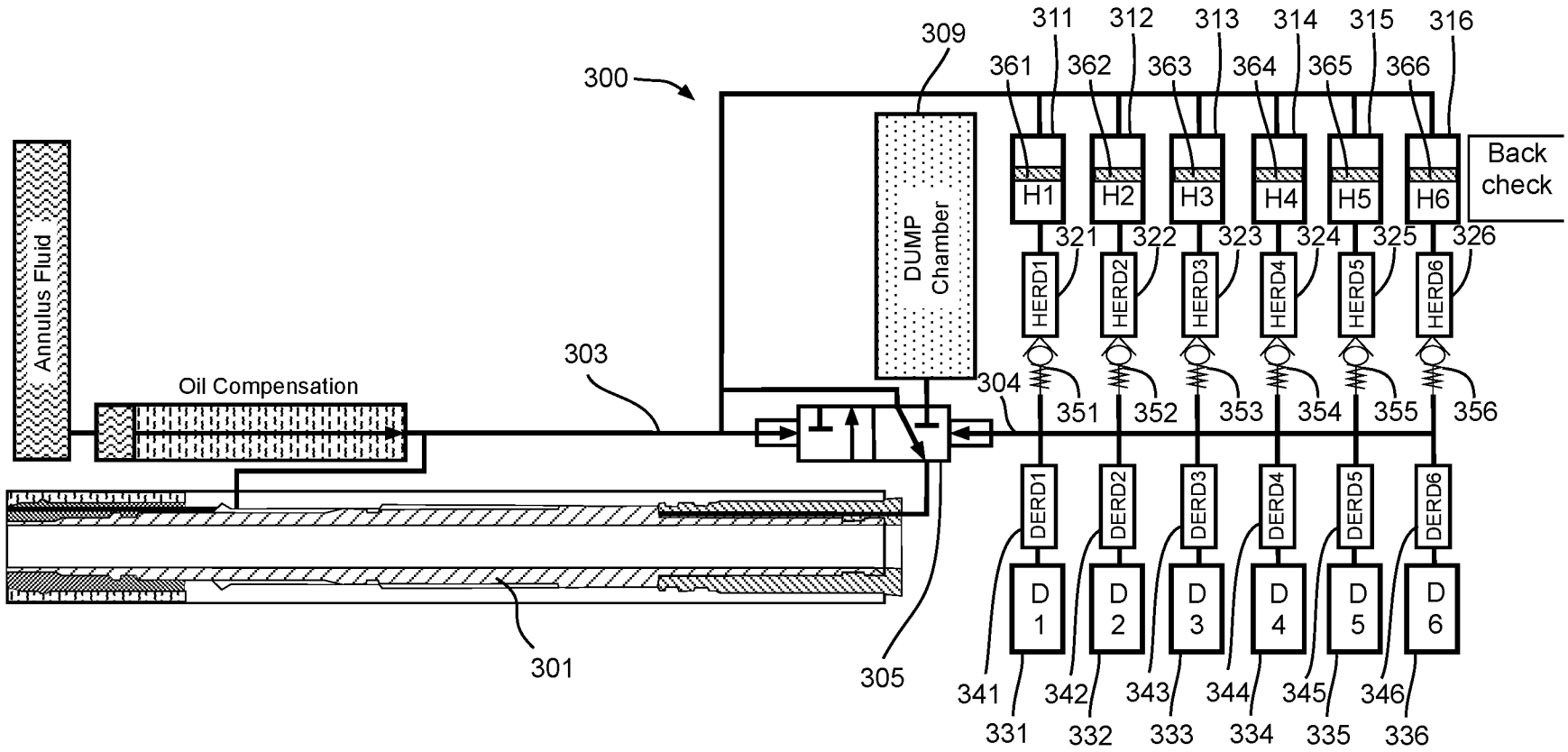
FIG. 3. A schematic illustration of another embodiment of this disclosure.

FIG. 3 shows another embodiment of this disclosure. A shown in FIG. 3, a multi-cycle tool 301 is connected to a pipe string (not shown) within a wellbore 302. The overall configuration is similar to FIG. 2, except back check valves 351,352,353,354,355,356 are each added to a corresponding hydraulic reservoir 311,312,313,314,315,316. The spring-loaded check valves 351,352,353,354,355,356 are one-directional valves or similar mechanisms designed to prevent back pressure caused by the reverse flow of the hydraulic fluid after actuating the dump actuator.

In this embodiment, in the first cycle, the operator fires the first actuator 321 to open the first hydraulic fluid reservoir 311 that contains hydraulic oil. The hydraulic oil then fills the pilot line 304 of the spool valve 305. The spool valve 305 therefore goes up, which in turn drives the power piston up inside the multi-cycle tool 301.

After a period of fluid flow, the operator fires the first dump actuator 341 to open the first dump cartridge 331. This also triggers the spool valve 305 to go down by allowing the hydraulic oil inside the pilot line 304 to dump into the first dump cartridge 331. The check valves 352, 353, 354, 355, 356 are protecting actuators 322, 323, 324, 325, 326 by preventing back pressure from acting on these actuators. With the pressure reduced in the hydraulic line 303, the power piston inside the multi-cycle tool 301 goes down and closes the multi-cycle tool 301.

Similarly, in the second cycle, the operator fires the second actuator 322 to open the second hydraulic fluid reservoir 312 that contains hydraulic oil. The hydraulic oil then fills the pilot line 304 of the spool valve 305. The spool valve 305 therefore goes up, which in turn drives the power piston up inside the multi-cycle tool 301.

After a second flow period, the operator again fires the second dump actuator 342 to open the second dump cartridge 332. This again triggers the spool valve 305 to go down by allowing the hydraulic oil inside the pilot line 304 to dump into the second dump cartridge 332. The check valves 353, 354, 355, 356 are protecting actuators 323, 324, 325, 326 by avoiding back pressure acting on these actuators. With the pressure reduced in the hydraulic line 303, the power piston inside the multi-cycle tool 301 goes down and opens the multi-cycle tool 301.

With six pairs of hydraulic reservoirs and dump cartridges and their corresponding actuators, the redundant circuitry 300 allows six one-time up and down cycles to open and close the multi-cycle tool 301. The six corresponding check valves also prevent hydraulic actuators encounters back pressure. Even in the case any one or more of the six pairs is not operational due to mechanical or electrical failure, the other pairs can still function as an alternative to ensure the functionality of the multi-cycle tool 301. More pairs of hydraulic reservoirs and dump cartridges could be similarly configured to provide additional cycles or redundancy.

Figure 4:
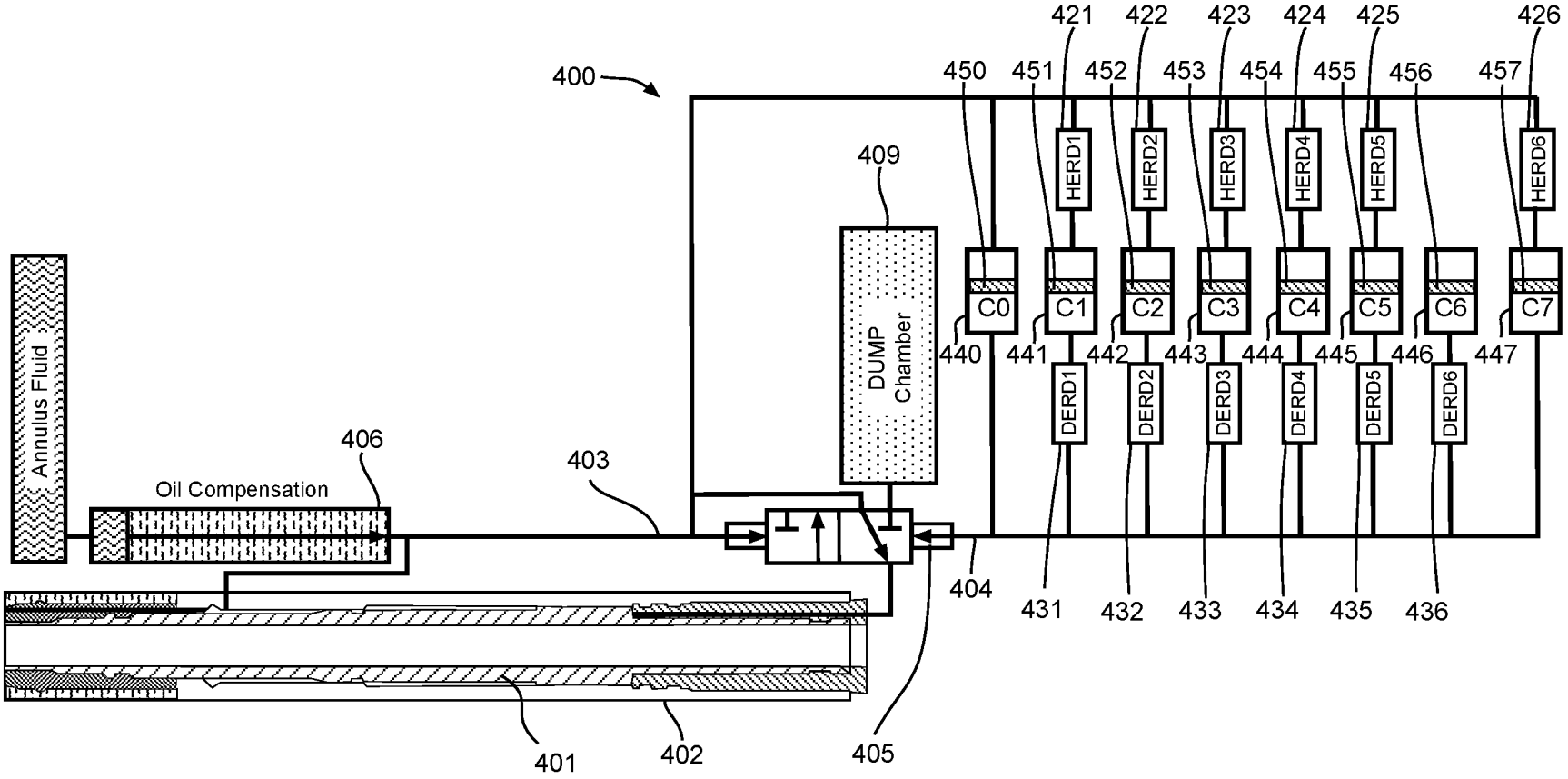
FIG. 4. A schematic illustration of another embodiment of this disclosure.

FIG. 4 shows another embodiment of this disclosure. A shown in FIG. 4, a multi-cycle tool 401 is connected to a pipe string (not shown) within a wellbore 402. Unlike the configurations shown in FIGS. 2 and 3, in FIG. 4 there is no corresponding single-action hydraulic fluid reservoir for each hydraulic actuator 421, 422, 423,424, 425, 426, nor is there single-action dump cartridge for each dump actuators 431, 432, 433, 434, 435, 436. Instead, the hydraulic fluid is initially supplied solely from the oil compensation 406. Each of the cartridges 440, 441, 442, 443, 444, 445, 446, 447 serves as a dual-action cartridge that is capable of receiving hydraulic oil in the pilot line 404 when the dump actuators are fired up, and then delivers the hydraulic oil back into the pilot line 404 upon firing the hydraulic actuators.

As shown in FIG. 4, in addition to the six cartridges 441, 442, 443, 444, 445, 446 like those in FIGS. 2 and 3, two additional dump cartridges 440, 447 are provided. Cartridge 440 is not coupled to any hydraulic or dump actuator. Cartridges 441, 442, 443, 444, 445 are operatively coupled to both hydraulic actuators 421, 422, 423, 424, 425 and dump actuators 431, 432, 433, 434, 435. Cartridge 446 is only operatively coupled to the dump actuator 436, whereas cartridge 447 is only operatively coupled to hydraulic actuator 426. Each cartridge contains a piston 450, 451, 452, 453, 454, 455, 456, 457.

Figure 6:
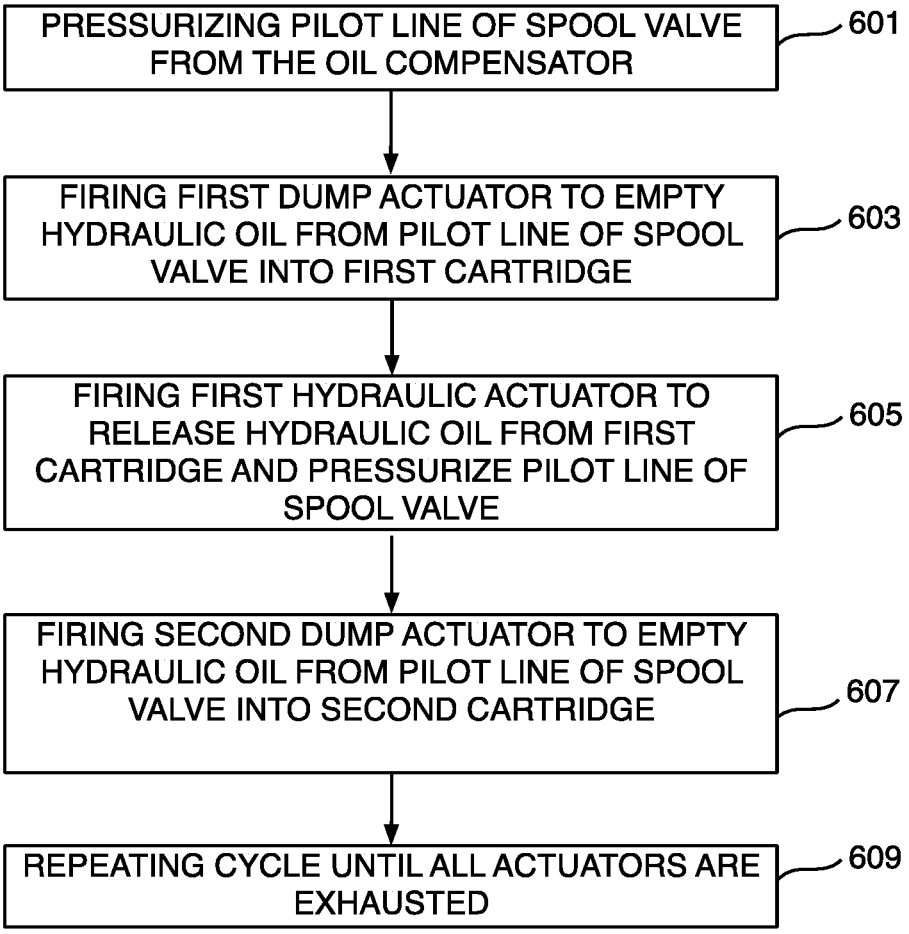
FIG. 6. A flow chart according to another embodiment of this disclosure.

The operation is described with reference to both FIG. 4 and FIG. 6. In this embodiment, starting from Step 601, the pilot line 404 of the spool valve 405 is initially pressurized by the hydraulic oil in the oil compensation 406, therefore the multi-cycle tool 401 is also closed.

In Step 603, to open the multi-cycle tool 401, the dump actuator 431 is actuated to empty the hydraulic fluid in the pilot line 404 into cartridge 441, and the spool valve 405 goes down.

In Step 605, to start the second cycle, hydraulic actuator 421 is actuated to push the hydraulic oil in cartridge 441 back to the pilot line 404, which also pushes up the spool valve and in turn the power piston inside multi-cycle tool 401.

In Step 607, after a period of flow time, dump actuator 432 is actuated to empty the hydraulic oil from pilot line 404 and into cartridge 442. At this time the spool valve 405 goes down, as well as the power piston inside the multi-cycle tool 401.

The cycle is repeated according to step 609, until all actuators coupled to cartridges 441-445 are exhausted. The six cycles end finally when dump actuator 436 is actuated to empty the hydraulic oil from the pilot line 404 into cartridge 446.

Cartridge 447 is filled with hydraulic oil, and serve as alternative redundancy along with hydraulic actuator 426 in case any of the hydraulic actuators 421, 422, 423, 424, 425 breaks down while the hydraulic oil is trapped inside any of cartridges 441, 442, 443, 444, 445 and not enough hydraulic oil is available in the hydraulic lines to pressurize and complete one cycle. The pressurized hydraulic oil inside cartridge 447 can then be reinjected into the system.

The elimination of hydraulic fluid reservoirs in this embodiment simplifies the circuitry design by employing fewer chambers while still keeping multi-cycle redundancy. Additionally, none of the actuators are subjected to back pressures. The additional hydraulic cartridge 447 also provide backup hydraulic oil to the system in case any one of the hydraulic actuators fails.

The foregoing description provides illustration and description, but is not intended to be exhaustive or to limit the inventive concepts to the precise form disclosed. Modifications and variations are possible in light of the above teachings or may be acquired from practice of the methodologies set forth in the present disclosure.

Even though particular combinations of features are recited in the claims and/or disclosed in the specification, these combinations are not intended to limit the disclosure. In fact, many of these features may be combined in ways not specifically recited in the claims and/or disclosed in the specification. Although each dependent claim listed below may directly depend on only one other claim, the disclosure includes each dependent claim in combination with every other claim in the claim set.

No element, act, or instruction used in the present application should be construed as critical or essential to the invention unless explicitly described as such outside of the preferred embodiment. Further, the phrase "based on" is intended to mean "based, at least in part, on" unless explicitly stated otherwise.

What is claimed is:

1. A system of operating a downhole hydraulic tool, comprising:
   - a hydraulic tool having at least one hydraulic port for receiving hydraulic fluid to control the movement of a piston inside the hydraulic tool;
   - a plurality of hydraulic reservoirs connected in parallel and each in fluid communication with the hydraulic port of the hydraulic tool, each of the hydraulic reservoirs being operatively connected to a corresponding hydraulic actuator that controls the release of hydraulic fluid from the hydraulic reservoirs, each of the hydraulic reservoirs having a piston therein; and
   - a plurality of dump containers each in fluid communication with the hydraulic port of the hydraulic tool, each of the dump containers being operatively connected to a corresponding dump actuator that controls the dump containers for receiving hydraulic fluid.

2. The system of claim 1, further comprising a flow direction controlling unit in fluid communication with the hydraulic fluid port of the hydraulic tool and with the hydraulic actuators and dump actuators.

3. The system of claim 2, wherein the plurality of hydraulic actuators and hydraulic reservoirs are in fluid communication with the hydraulic fluid port of the hydraulic tool through the flow direction controlling unit.

4. The system of claim 2, wherein the plurality of dump actuators and dump containers are in fluid communication with the hydraulic fluid port through the flow direction controlling unit.

5. The system of claim 1, further comprising a back check valve for each of the hydraulic actuators.

6. The system of claim 1, wherein the downhole hydraulic tool is a packer.

7. The system of claim 1, wherein the downhole hydraulic tool is a downhole valve.

8. A system of operating a downhole hydraulic tool, comprising:
   - a hydraulic tool having at least one hydraulic port for receiving hydraulic fluid to control the movement of a piston inside the hydraulic tool;
   - a plurality of hydraulic actuators connected in parallel and each in fluid communication with the hydraulic port of the hydraulic tool; and
   - a plurality of dump actuators connected in parallel and each in fluid communication with the hydraulic port of the hydraulic tool;
   - a plurality of hydraulic containers in fluid communication with the hydraulic port of the hydraulic tool, the plurality of hydraulic containers each operatively coupled to one of the plurality of hydraulic actuators and one of the plurality of dump actuators, each of the hydraulic containers having a piston therein; and
   - a hydraulic pressure compensating unit in fluid communication with the hydraulic port of the hydraulic tool.

9. The system of claim 8, further comprising a flow direction controlling unit in fluid communication with the hydraulic fluid port of the hydraulic tool and with the hydraulic actuators and dump actuators.

10. The system of claim 9, wherein the plurality of hydraulic actuators and hydraulic reservoirs are in fluid communication with the hydraulic fluid port of the hydraulic tool through the flow direction controlling unit.

11. The system of claim 9, wherein the plurality of dump actuators and dump containers are in fluid communication with the hydraulic fluid port through the flow direction controlling unit.

12. The system of claim 8, further comprising an additional hydraulic fluid reservoir in fluid communication with the hydraulic port of the hydraulic tool.

13. The system of claim 12, wherein the hydraulic fluid reservoir is operatively coupled to a backup hydraulic actuator.

14. The system of claim 8, wherein the downhole hydraulic tool is a packer.

15. A method of operating a multi-cycle downhole tool, the multi-cycle downhole tool having at least one hydraulic port for receiving hydraulic fluid to control the movement of a piston inside the hydraulic tool, a plurality of hydraulic reservoirs each in fluid communication with the hydraulic port of the hydraulic tool, each of the hydraulic reservoirs being operatively connected to a corresponding hydraulic actuator that controls the release of hydraulic fluid from the hydraulic reservoirs, each of the hydraulic reservoirs having a piston therein, and a plurality of dump containers each in fluid communication with the hydraulic port of the hydraulic tool and being operatively connected to a corresponding dump actuator that controls the dump containers for receiving hydraulic fluid, the method comprising:

firing one of the dump actuators to drain hydraulic fluid into the corresponding dump container;

firing one of the hydraulic actuators to release hydraulic fluid from the corresponding hydraulic reservoir to the hydraulic port of the hydraulic tool; and repeating the firing one of the dump actuators and the firing one of the hydraulic actuators.

16. The method of claim 15, wherein each of the hydraulic reservoirs and the hydraulic actuators are only operated one-time.

17. The method of claim 15, wherein each of the dump containers and the dump actuators are only operated one-time.

18. The method of claim 15, further comprising a flow direction controlling unit in fluid communication with the hydraulic fluid port of the hydraulic tool and with the hydraulic actuators and dump actuators.

19. The method of claim 18, wherein the plurality of hydraulic actuators and hydraulic reservoirs are in fluid communication with the hydraulic fluid port of the hydraulic tool through the flow direction controlling unit.

20. The method of claim 18, wherein the plurality of dump actuators and dump containers are in fluid communication with the hydraulic fluid port through the flow direction controlling unit.

* * * * *